US007258502B2

(12) United States Patent
Nagae et al.

(10) Patent No.: US 7,258,502 B2
(45) Date of Patent: Aug. 21, 2007

(54) TAPE PRODUCING APPARATUS

(75) Inventors: Tsuyoshi Nagae, Kasugai (JP); Toshio Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/267,164

(22) Filed: Nov. 7, 2005

(65) Prior Publication Data

US 2006/0120791 A1 Jun. 8, 2006

(30) Foreign Application Priority Data

Dec. 3, 2004 (JP) ..... 2004-351151

(51) Int. Cl.
*B41J 11/00* (2006.01)
*B41J 2/325* (2006.01)

(52) U.S. Cl. ..... 400/611; 347/218

(58) Field of Classification Search ..... 347/16, 347/101, 218; 400/582, 611, 615.2, 613; 156/359, 379.6; 235/462.08; *B41J 3/36, B41J 11/42, 21/00*

See application file for complete search history.

(56) References Cited

U.S. PATENT DOCUMENTS 4,748,479 A * 5/1988 Ohira et al. ..... 355/72
4,797,016 A * 1/1989 Lahr ..... 400/237
4,880,325 A * 11/1989 Ueda et al. ..... 400/249
5,409,317 A * 4/1995 Ueno et al. ..... 400/61
5,445,463 A * 8/1995 Paranjpe ..... 400/240
6,344,891 B1 * 2/2002 Imai ..... 355/40
6,380,965 B1 * 4/2002 Sims et al. ..... 347/218
6,386,671 B1 * 5/2002 Huston et al. ..... 347/16
6,989,180 B2 * 1/2006 Keeton et al. ..... 428/32.6
2002/0025208 A1 * 2/2002 Sato et al. ..... 400/120.01
2003/0068184 A1 * 4/2003 Miyano ..... 400/582
2003/0095810 A1 * 5/2003 Haines et al. ..... 399/84
2003/0226642 A1 * 12/2003 Okayasu et al. ..... 156/359

FOREIGN PATENT DOCUMENTS

EP 1 369 251 A 12/2003
JP A 8-183205 7/1996
JP A 2001-88359 4/2001

* cited by examiner

*Primary Examiner*—Edward Lefkowitz
*Assistant Examiner*—Jonathan Dunlap
(74) *Attorney, Agent, or Firm*—Oliff & Berridge, PLC

(57) ABSTRACT

It is intended to provide a tape producing apparatus capable of printing on an appropriate printing medium with high quality based on data directly read from marks which are continuously printed on a release paper to show a type of a printing medium, with non-contact tape type identification devices. The tape producing apparatus comprises non-contact tape type discrimination sensors. Each label tape includes the adhesive and the release paper for protecting the adhesive. The release paper is provided with only one of the tape type identification marks which are printed continuously to show the types of the materials to produce the label tape. The non-contact tape type discrimination sensors read the tape type identification marks which are printed continuously to show the types of the materials to produce the label tape.

12 Claims, 11 Drawing Sheets

EXAMPLE OF SHOWING TAPE TYPE DISCRIMINATION MARKS

60

| TAPE TYPE IDENTIFICATION MARK | TAPE TYPES | TAPE WIDTHS (mm) | COLORS OF INK RIBBON | COLORS OF ADHESIVE TAPE |
|---|---|---|---|---|
| AAAA | LAMINATED | 6 | BLACK | TRANSPARENT |
| AAAB | LAMINATED | 6 | BLACK | WHITE |
| AAAD | LAMINATED | 6 | BLACK | RED |
| AAAE | LAMINATED | 6 | BLACK | YELLOW |
| AAAF | LAMINATED | 6 | BLACK | BLUE |
| AAAG | LAMINATED | 6 | BLACK | GREEN |
| AABA | LAMINATED | 6 | RED | TRANSPARENT |
| AABB | LAMINATED | 6 | RED | WHITE |

FIG. 5A

EXAMPLE OF SHOWING TAPE TYPE DISCRIMINATION MARKS

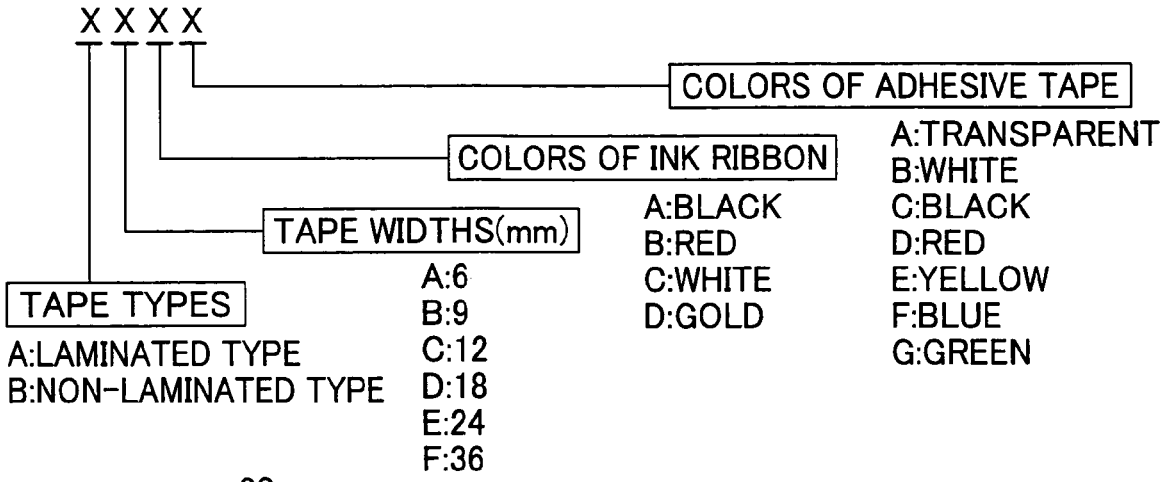

60

| TAPE TYPE IDENTIFICATION MARK | TAPE TYPES | TAPE WIDTHS (mm) | COLORS OF INK RIBBON | COLORS OF ADHESIVE TAPE |
|---|---|---|---|---|
| AAAA | LAMINATED | 6 | BLACK | TRANSPARENT |
| AAAB | LAMINATED | 6 | BLACK | WHITE |
| AAAD | LAMINATED | 6 | BLACK | RED |
| AAAE | LAMINATED | 6 | BLACK | YELLOW |
| AAAF | LAMINATED | 6 | BLACK | BLUE |
| AAAG | LAMINATED | 6 | BLACK | GREEN |
| AABA | LAMINATED | 6 | RED | TRANSPARENT |
| AABB | LAMINATED | 6 | RED | WHITE |
| | | | | |

EXAMPLE OF SHOWING TAPE TYPE
IDENTIFICATION MARKS ON RELEASE PAPER

TAPE PRODUCING APPARATUS

TECHNICAL FIELD

The disclosure relates to a tape producing apparatus for printing on a tape printing medium, especially to a method of showing and discriminating a type of the tape printing medium and ink.

BACKGROUND

Conventionally, a tape producing apparatus for printing characters such as letters on a print tape, i.e., a long printing medium is structured to have a tape cassette, in which a cassette case of a predetermined shape houses the print tape and an ink ribbon for printing on the print tape, being mounted into a printing mechanism, and to produce a label tape by printing the characters with a thermal head on the label tape overlapped on the ink ribbon which are fed from the tape cassette.

Types of the print tape housed in the tape cassette include a transparent film tape of a predetermined width, a film tape provided with a release paper adhering to one side thereof with an adhesive, and a heat-sensitive tape having a self color development property (so-called, a thermal paper), each of which has varieties of widths. Additionally, there are ink ribbons of various colors to print on the transparent film tape. Each tape is wound on a tape spool and housed in the cassette case of the tape cassette.

The tape producing apparatus needs to receive information from the tape cassette to provide a high-quality printing and proper feeding for printing mediums of the various tape cassettes.

Japanese patent application laid-open No. 2001-88359 discloses a tape producing apparatus having tape type discrimination sensors made of a well-known mechanical switch comprising a plunger and a push-typed micro switch, and placed in a corner of a cassette storage part. A tape type of the tape cassette is detected based on an on/off signal representing the presence or absence of each sensor hole corresponding to each sensor in the cassette case of the tape cassette.

However, there has been a problem that the tape producing apparatus in the above publication cannot turn the switch on if the cassette case is not set or fixed with great precision, since an on-off stroke of the mechanical switch composed of the micro switch and others is short. There is also a risk that the switch is damaged when the cassette case is pushed into the cassette storage part of the tape printer by force.

Further, the number of sensor holes, or switches increases with increase in tape cassette variations, which raises costs. The tape producing apparatus cannot achieve commonality of the tape cassette case because there are sensor holes in the cassette case.

The tape type discrimination sensors can hardly find that the wrong tape cassette which does not meet the result of the tape type discrimination is housed in the tape cassette since the tape type in the tape cassette is detected based on an on/off signal representing the presence or absence of each sensor hole corresponding to each sensor in the cassette case of the tape cassette.

SUMMARY

The disclosure has been made in view of the above circumstances and has an object to overcome the above problems and to provide a tape producing apparatus capable of printing on an appropriate printing medium with high quality based on data directly read from marks which are continuously printed on a release paper to show a type of the printing medium, with non-contact tape type identification devices.

To achieve the purpose of the invention, there is provided a tape producing apparatus comprising a tape printing medium, a printing device for printing characters and symbols on the tape printing medium by making ink adhere thereto, a label tape to be produced from the tape printing medium on which the printing device prints, an adhesive applied on the label tape, a release paper for protecting the adhesive, tape type identification marks for showing a type of a material to produce the label tape, and a non-contact tape type discrimination device for reading the tape type identification marks.

In the above tape producing apparatus, each label tape includes the adhesive and the release paper for protecting the adhesive. The release paper is provided with the tape type identification marks which are printed continuously to show the type of the material to produce the label tape. The non-contact tape discrimination sensors read the tape type identification marks which are printed continuously to show the type of the material to produce the label tape. Therefore, using the non-contact tape discrimination sensors develops reliability in contrast to a mechanical switch, and positioning tolerance can be larger. Since the cassette case does not have sensor holes, the cassette case can be standardized, which can reduce costs. The non-contact tape discrimination sensors can read data from any part of the tape type identification marks. The sensors read the data of the marks directly. If anything other than the predetermined material to produce the label tape is installed in the cassette case, the apparatus can terminate the process promptly and prevent troubles from occurring.

BRIEF DESCRIPTION OF THE DRAWINGS

FIG. 5A shows a part of an example of a tape discrimination data table which is stored in a tape discrimination data storage area of the tape producing apparatus of the first embodiment;

DETAILED DESCRIPTION OF THE PREFERRED EMBODIMENTS

Figure 1:
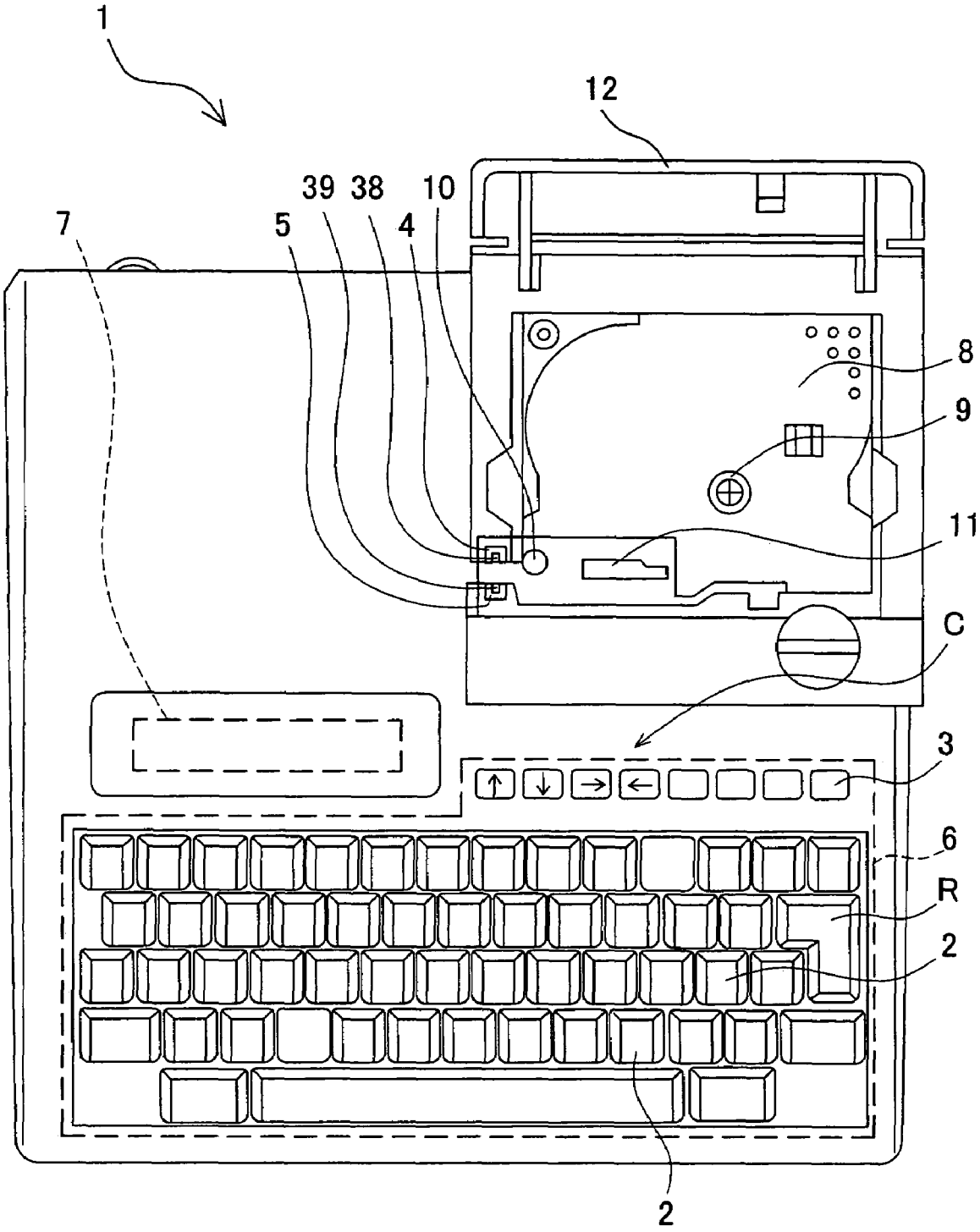
FIG. 1 is a plan view of a tape producing apparatus in a first embodiment when a housing cover of a tape cassette housing part is opened.

A detailed description of a first preferred embodiment of the disclosure will now be given referring to the accompanying drawings. Firstly, a schematic structure of a tape producing apparatus in the first embodiment will be explained with reference to FIG. 1. FIG. 1 is a plan view of the tape producing apparatus in the first embodiment when a housing cover of a tape cassette housing part is opened.

As shown in FIG. 1, there is placed a keyboard 6, a liquid crystal display 7 (hereinafter, "LCD"), and a cassette housing part 8 in the tape producing apparatus 1. The keyboard 6 has character input keys 2 for entering characters such as letters in multiple lines to create text composed of document data (code data), print keys 3 for instructing printing of the text, cursor keys C for moving a cursor up and down and left and right on the LCD 7, and a return key R for issuing instruction for starting a new line, and executing various processes and selections. The LCD 7 displays the characters and the like entered with the keyboard 6. The cassette housing part 8 houses a tape cassette 21 (see FIG. 2) described below in detail.

The cassette housing part 8 incorporates a ribbon take-up shaft 9 which is rotated and driven through a tape feed motor 37*a* (see FIG. 4) by way of an appropriate driving mechanism. The ribbon take-up shaft 9 is fitted in an ink ribbon take-up reel 32 (see FIGS. 2, 3) which takes up a spent strip of an ink ribbon, and rotates and drives the ink ribbon take-up reel 32 synchronously with printing speed.

A tape drive roller shaft 10 is provided obliquely ahead of the ribbon take-up shaft 9 (on the keyboard 6 side in FIG. 1). The tape drive roller shaft 10 is rotated and driven through the tape feed motor 37*a* by way of an appropriate transmitting mechanism comprised of a stepping motor and the like, and rotates and drives a tape drive roller 37 (see FIGS. 2, 3). A thermal head 11 (corresponding to a printing device) for printing characters onto each print tape 22, 46 (see FIGS. 2, 3) are fixed forward of the cassette housing part 8 (on the keyboard 6 side in FIG. 1). Facing to the thermal head 11, a roller support body 13 (see FIGS. 2, 3) is placed rotatably, and a platen roller 14 and a feed roller 15 (see FIGS. 2, 3) are turnably installed on the roller support body 13. The platen roller 14 and the feed roller 15 are as wide as or wider than 36 mm which is the maximum width of the print tape 22. Tape type discrimination sensor 4 (corresponding to a tape type discrimination device) is provided facing to an exit 43 for a label tape 35 from the tape cassette 21 described later in the cassette housing 8 (see FIG. 2) to read the type of the tape cassette 21 including a line sensor, which is comprised of a publicly known line CCD (charge-coupled device) 38. Another tape type discrimination sensor 5 (corresponding to the tape type discrimination device) is provided facing to an exit 44 for a label tape 49 from the tape cassette 45 described later in the cassette housing part 8 (see FIG. 3) to read the type of the tape cassette 45 including the line sensor, which is comprised of a publicly known line CCD 39. The line CCDs 38, 39 transfer an electron converted by receiving light in a photodiode to a CCD for horizontal output through a transform gate. The tape type discrimination sensors 4, 5 read the type of the tape cassette 21, 45 respectively by reading tape type identification marks 61 which are printed continuously in a release paper 16 to show the type of the materials to produce the label tape. The cassette housing part 8 is opened or closed by a pivoting housing cover 12 rotatably connected to a rear end of the tape producing apparatus 1. In an open state, the tape cassette 21 can be replaced with another.

Figure 2:
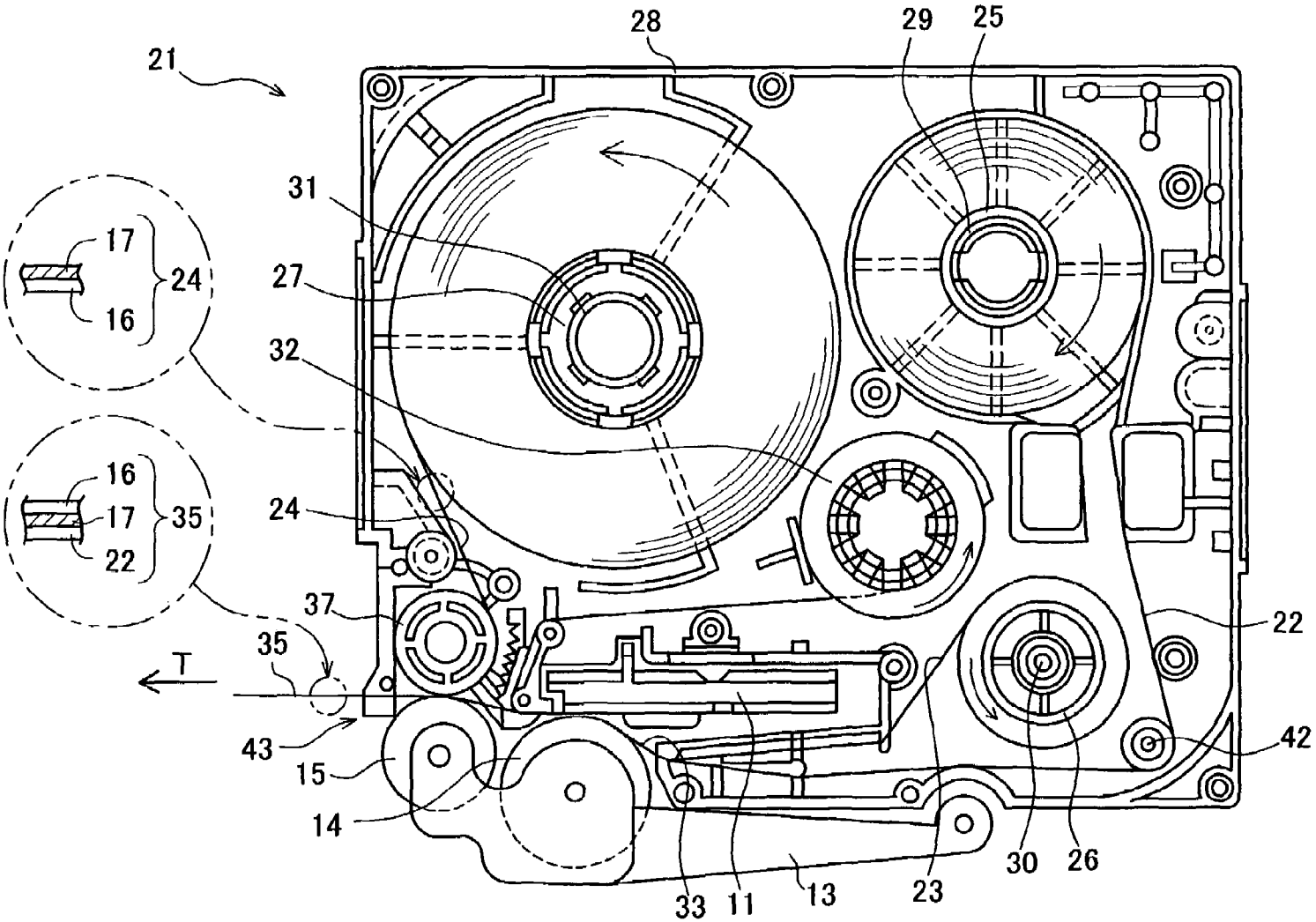
FIG. 2 is a plan view of a main part of a tape cassette of a laminated type when the cassette is mounted into the tape producing apparatus without its top cover.

Next, the schematic structure of a laminated tape cassette 21 of the first embodiment will be explained with reference to FIG. 2. FIG. 2 is a plan view of a main part of the tape cassette 21 of the laminated type when the cassette is mounted into the tape producing apparatus without its top cover. As shown in FIG. 2, the tape cassette 21 has a print tape 22 formed of a transparent tape and the like, an ink ribbon 23 for printing on the print tape 22, and a double-sided adhesive tape 24 (hereinafter, "adhesive tape"), including an adhesive 17 and a release paper 16, which will be laminated on the back of the printed print tape 22. The print tape 22, the ink ribbon 23, and the adhesive tape 24 are wound on a tape spool 25, a reel 26, and a tape spool 27 respectively, and are rotatably fitted on a cassette boss 29, a reel boss 30, and a cassette boss 31 that are protrusively formed on a bottom wall of a cassette case 28. The tape cassette 21 further has the ink ribbon take-up reel 32 which takes up a spent strip of the ink ribbon 23. For direct reading of a type of the tape cassette 21, the release paper 16 of the adhesive tape 24 is provided with the tape type identification marks 61 continuously printed to show the type of the material to produce the label tape 35 (see FIG. 5). The tape cassette 21, including the print tape 22 of various widths which are 6 mm, 9 mm, 12 mm, 18 mm, 24 mm and 36 mm, is prepared. The widths of the print tape 22 affect the widths of the ink ribbon 23 and the adhesive tape 24, the types of the tape spools 25, 27, and the reel 26, and the width and the thickness of the tape cassette 21. Additionally, the tape type discrimination sensor 4 including the line sensor and the like to discriminate the type of the tape cassette 21 is provided in the exit 43 (see FIG. 2) of the label tape 35 from the tape cassette 21 in the cassette housing part 8. When the tape type discrimination sensor 4 reads "ABCD" from the tape type identification marks 61 which are continuously printed on the release paper 16 to show the type of the material to produce the label tape 35, the tape cassette 21 to produce the laminated label tape 35 which is 9 mm wide and has a red background with white letters is mounted in the cassette housing part 8 (see FIG. 5). Further, the tape drive roller 37 which rotates with a driving of the tape feed motor 37*a* is turnably placed in the lower side of the tape cassette 21 (the left lower side in FIG. 2). The tape drive roller 37 is as wide as or wider a little than the print tape 22 being stored.

The print tape 22 unwound from the tape spool 25 passes by the guide pin 42, and is overlapped on the unspent ink ribbon 23 unwound from the reel 26. The print tape 22 and the ink ribbon 23 enter an opening portion 33, and then pass through the thermal head 11 and the platen roller 14. The platen roller 14 works for pressing the print tape 22 and ink ribbon 23 in an overlapping relation against the thermal head 11 on printing. Then, the ink ribbon 23 reaches the ink ribbon take-up reel 32, and is wound on the ink ribbon take-up reel 32.

The adhesive tape 24 is wound on the tape spool 27 and stored therewith in a state where one side surface of the adhesive tape 24 is overlapped with the release paper being on the outside. The adhesive tape 24 unwound from the tape spool 27 passes through the tape drive roller 37 and the feed roller 15. The feed roller 15 works for producing the label tape 35 by pressing the printed print tape 22 with the adhesive surface of the adhesive tape 24 having no release paper against the tape drive roller 37. This operation effects on feeding the label tape 35 in the direction indicated by an arrow T. In both upper and lower ends of the adhesive tape 24, there are spacers made of a resin film (not shown).

Figure 3:
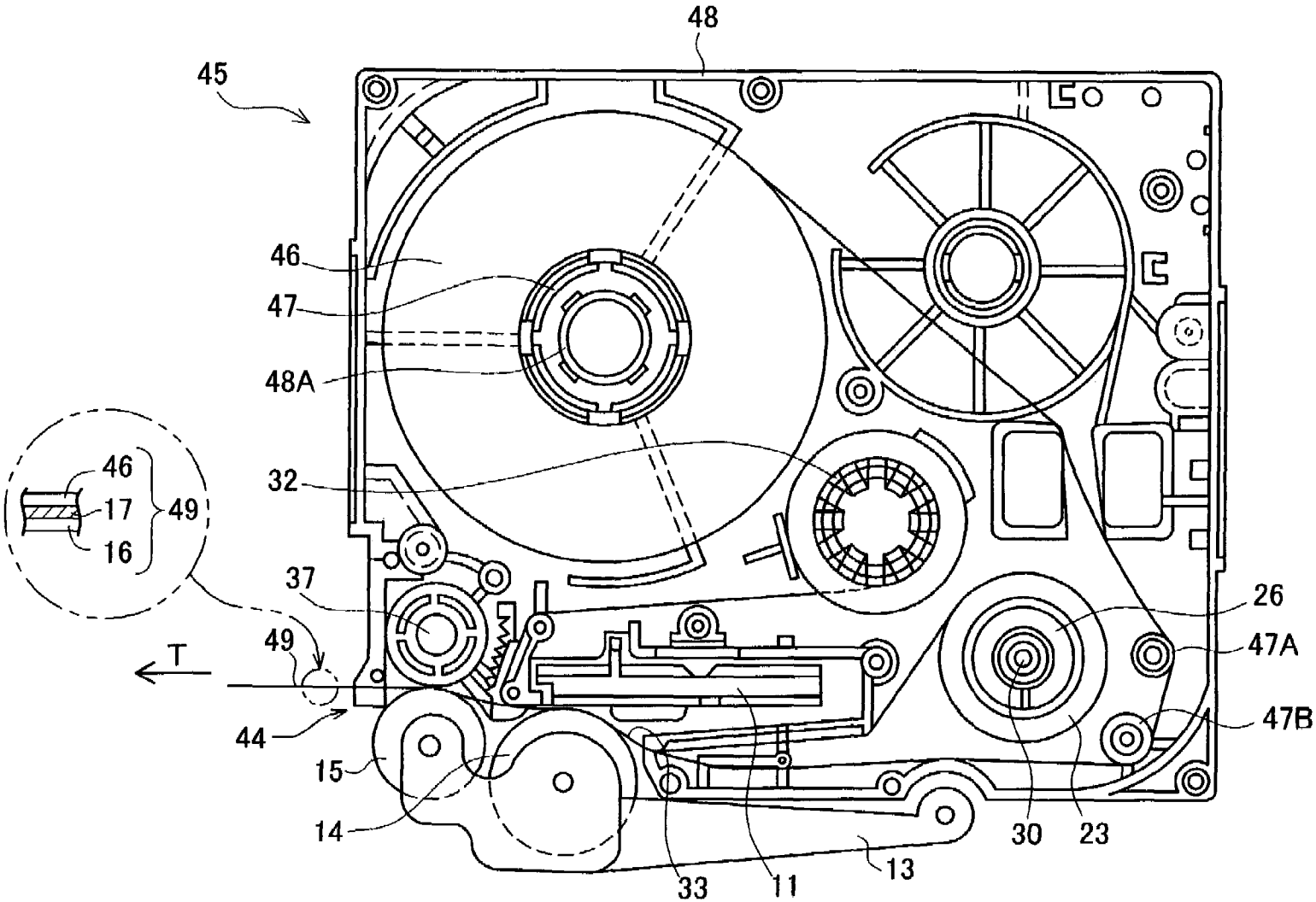
FIG. 3 is a plan view of a main part of a tape cassette of a non-laminated type when the cassette is mounted into the tape producing apparatus without its top cover.

Next, the schematic structure of a non-laminated tape cassette 45 of the first embodiment will be explained with reference to FIG. 3. FIG. 3 is a plan view of a main part of the tape cassette 45 of the non-laminated type when the cassette is mounted into the tape producing apparatus without its top cover. As shown in FIG. 3, the structure of the tape cassette 45 is almost the same as that of the laminated tape cassette 21. However, instead of the transparent print tape 22 and the adhesive tape 24, the print tape 46 including the adhesive 17 applied its back side and the release paper 16 stuck on the back side is wound on a tape spool 47 with the release paper 16 being on the outside. The print tape 46 is stored in a cassette case 48 so that the print tape 46 is rotatably fitted onto a cassette boss 48A standing on the bottom face of the cassette case 48. For direct reading of the type of the tape cassette 45, the tape type identification marks 61 are printed continuously on the release paper 16 to show the type of the materials to produce a label tape 49 (see FIG. 5). The ink ribbon 23 for printing characters onto the print tape 46 is wound on the reel 26, and fitted onto the reel boss 30 standing on the bottom face of the cassette case 48. In upper and lower ends of the print tape 46, there are the spacers made of the resin film (not shown). Further, the ink ribbon take-up reel 32 is provided for taking up the spent ink ribbon 23. The tape cassette 45 as above includes the print tape 46 of various widths which are 6 mm, 9 mm, 12 mm, 18 mm, and 24 mm. The widths of the print tape 46 affect the widths of the ink ribbon 23, the type of the tape spool 47 and the reel 26, and the width and the thickness of the tape cassette 45. Additionally, tape type discrimination sensor 5 including a line sensor and the like to discriminate the type of the tape cassette 45 is provided in the exit 44 (see FIG. 3) of the label tape 49 from the tape cassette 45 in the cassette housing part 8. When the tape type discrimination sensor 5 reads "BBCD" from the tape type identification marks 61 which are continuously printed on the release paper 16 to show the type of the material to produce the label tape 49, the tape cassette 45 to produce the non-laminated label tape 49 which is 9 mm wide and has a red background with white letters is mounted in the cassette housing part 8 (see FIG. 5). Further, the tape drive roller 37 which rotates with a driving of the tape feed motor 37*a* is turnably placed in the lower side of the tape cassette 45 (the left lower side in FIG. 3). The tape drive roller 37 is as wide as or wider a little than the print tape 46 being set.

The print tape 46 unwound from the tape spool 47 passes by guide pins 47A, 47B, and is overlapped on the unspent ink ribbon 23 unwound from the reel 26. The print tape 46 and the ink ribbon 23 enter the opening portion 33, and then pass through the thermal head 11 and the platen roller 14. The platen roller 14 works for pressing the print tape 46 and the ink ribbon 23 in the overlapping relation against the thermal head 11 during printing. Then, the ink ribbon 23 reaches the ink ribbon take-up reel 32, and is wound on the ink ribbon take-up reel 32.

The print tape 46 printed with the thermal head 11 passes through the tape drive roller 37 and the feed roller 15. The feed roller 15 works for pressing the printed face of the print tape 46 on the tape drive roller 37, and feeding the label tape 49 in the direction of the arrow T.

Figure 4:
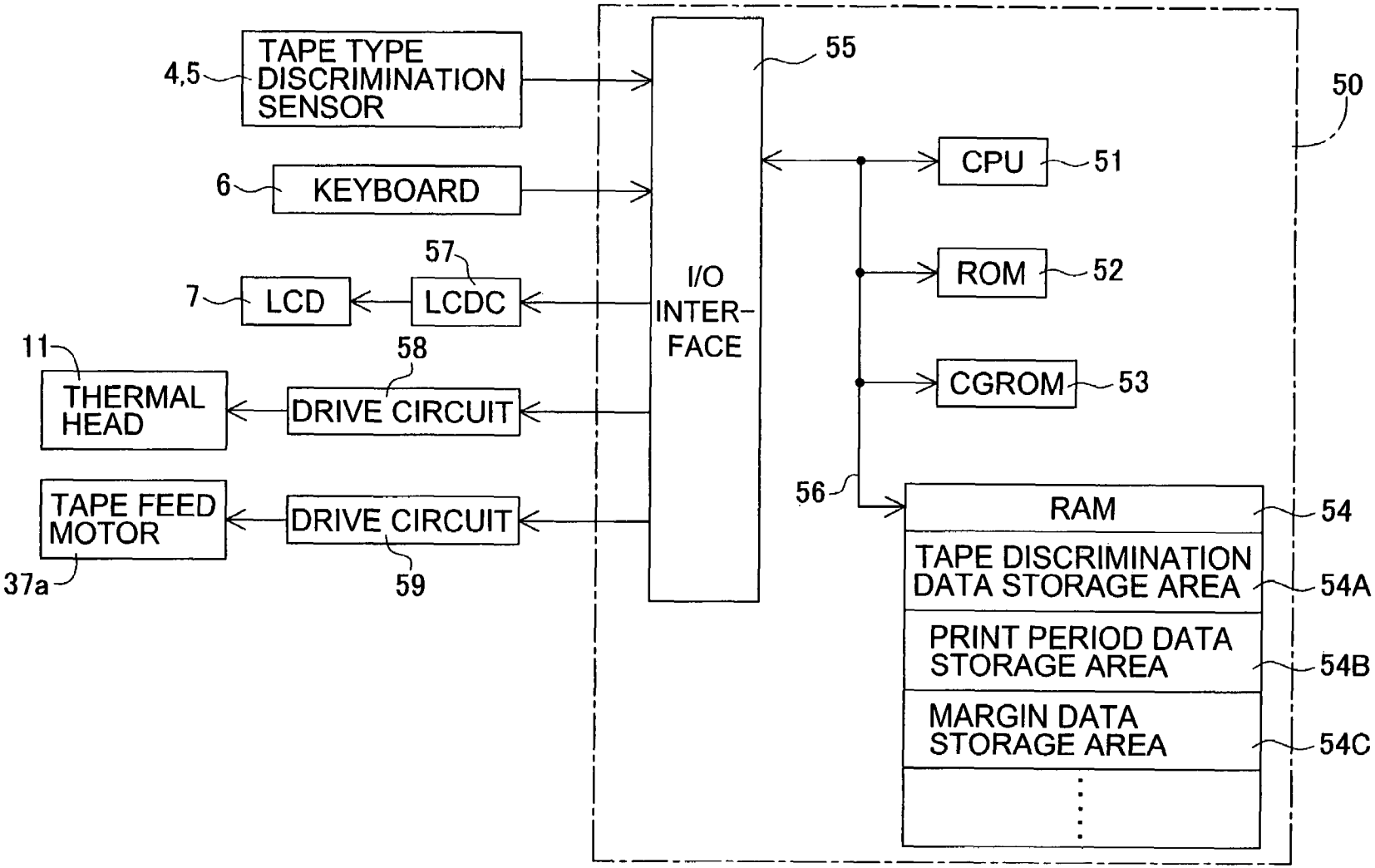
FIG. 4 is a block diagram showing a control structure of the tape producing apparatus.

Next, a control system of the tape producing apparatus 1 constructed as above will be explained with reference to FIG. 4. FIG. 4 is a block diagram showing a control structure of the tape producing apparatus of the first embodiment. As shown in FIG. 4, a control section 50 is constructed of CPU 51, ROM 52, CGROM 53, RAM 54 and an input/output (I/O) interface 55 and they are connected to one another via a bus line 56.

ROM 52 stores a variety of programs such as a print control program mentioned later and other programs necessary for controlling the tape producing apparatus 1. CPU 51 operates various calculations based on the programs stored in ROM 52. ROM 52 also stores an outline data which determines an outline of each of various characters, classified by fonts (Gothic font, Mincho font (Japanese type font), and other fonts) in association with code data. Based on the outline data, dot pattern data is developed on an image buffer.

CGROM 53 stores the dot pattern data corresponding to each of the characters input with the keyboard 6. The dot pattern is displayed on the LCD 7 based on the dot pattern data read from CGROM 53. RAM 54 is used for temporarily storing calculations results calculated by CPU 51, and has a tape discrimination data storage area 54A in which a tape discrimination data table 60 (see FIG. 5) described later is stored. The tape discrimination data table 60 is used for discrimination of the type of the tape cassette 21 installed in the cassette housing part 8. To improve print quality, the RAM 54 includes a print period data storage area 54B in which a print period data table (described later) is stored. The print period data table will be selected based on the tape width and the tape type in the tape discrimination data table 60 to print on the print tape 22 with the thermal head 11. To improve finished quality of the label tape, the RAM 54 includes a margin data storage area 54C in which a normal margin data table and contiguous margin data table which will be selected based on the tape width and the tape type in the tape discrimination data table 60 to determine the margin after printing. RAM 54 also has the image buffer, a text memory, a print buffer and various kinds of memories.

The I/O interface 55 is connected to the tape type discrimination sensors 4, 5 and the keyboard 6 provided in the cassette housing part 8. The I/O interface 55 is also connected to a display controller (LCDC) 57 which drives and controls the LCD 7. When the characters are entered by the character input keys 2 of the keyboard 6, the document data is stored successively in the text memory. At the same time, the dot pattern corresponding to the characters entered with the keyboard 6 is displayed on the LCD 7 based on a dot pattern generation control program and a display control program. A drive circuit 58 which drives and controls the thermal head 11 is also connected to the I/O interface 55, and works together with the platen roller 14 to print the dot pattern data, which is transferred from the image buffer to the print buffer, onto the print tape 22 through the ink ribbon 23. The drive circuit 59 which drives and controls the tape feed motor 37*a* is further connected to the I/O interface 55, and works together with the feed roller 15 to feed the label tape 35 while placing the adhesive tape 24 on the label tape 49 and the print tape 22 which are printed.

When the tape cassette 45 is set, the tape cassette 45 and the print tape 46 (see FIG. 3) can be replaced with the tape cassette 21 and the print tape 22 respectively in the above explanation of the control system.

Figure 5B:
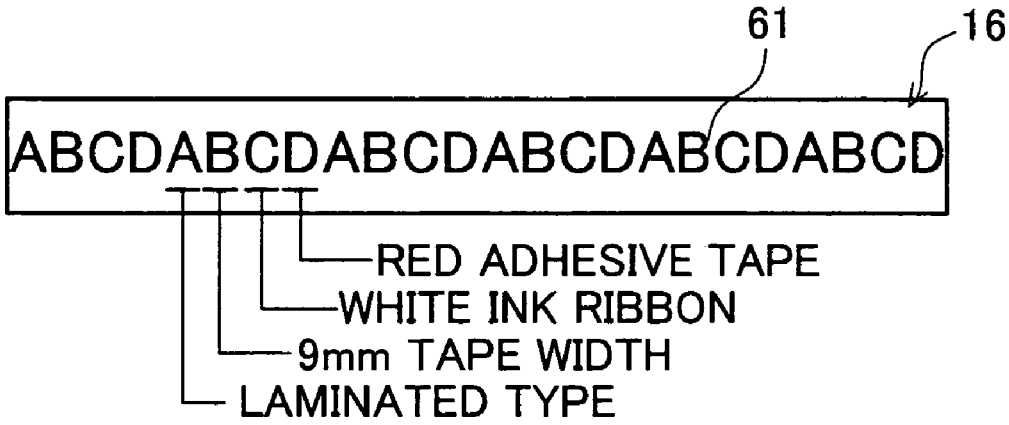
FIG. 5B shows an example of a release paper in which tape type identification marks are printed.

Next, the tape discrimination data table 60 which is stored in the tape discrimination data storage area 54A of RAM 54 will be explained with reference to FIGS. 5A and 5B. FIG. 5A shows a part of an example of the tape discrimination data table which is stored in the tape discrimination data storage area of the tape producing apparatus of the first embodiment. The tape discrimination data table 60 indicates tape types, tape widths, colors of ink ribbon, and colors of adhesive tape as marks, showing combinations of them.

As shown in FIG. 5A, the tape discrimination data table 60, which is selected to determine the type of the tape cassette 21 installed in the cassette housing part 8, includes "tape types", "tape widths", "colors of ink ribbon", "colors of adhesive tape" and "tape type identification marks". The "tape types" indicate the types of the print tape, i.e., presence or absence of a surface protection film of the tape. The "tape widths" indicate the tape widths of the tape. The "colors of ink ribbon" show the colors of the printed characters of the tape. The "colors of adhesive tape" show the colors of background of the print tape. The "tape types identification marks" show the type of the print tape. The "tape types" include the "non-laminated type" and the "laminated type", which are registered in advance. The "non-laminated type" is the print tape 46 previously provided with the adhesive and the release paper on the surface. The "laminated type" is the transparent print tape 22 of which a printing surface is allowed to adhere to the adhesive surface of the adhesive tape 24. The "tape widths" for "the non-laminated tape" are 6 mm, 9 mm, 12 mm, 18 mm, and 24 mm, which are previously registered. The "tape widths" for "the laminated tape" are 6 mm, 9 mm, 12 mm, 18 mm, 24 mm, and 36 mm, which are previously registered. The "tape type identification marks" which are read by the tape type discrimination sensors 4, 5 are registered in advance. The "colors of ink ribbon" and the "colors of adhesive tape" are always different from each other in any combination in the tape discrimination data table 60.

Based on the tape discrimination data table 60 in FIG. 5A, FIG. 5B shows an example of the release paper 16 in which the tape type identification marks 61 are printed. When the tape of which the "tape type" is "laminated type", "tape width" is "9 mm", "color of ink ribbon" is "white" and "color of adhesive tape" is "red" is stored in the tape cassette 21 the tape type discrimination sensor 4 directly reads the "tape type identification marks" as "ABCD".

When the tape cassette 45 is set, tape cassette 45 and the print tape 46 (see FIG. 3) can be replaced with the tape cassette 21 and the print tape 22 respectively, in the above explanation of the tape discrimination data table.

Figure 12:
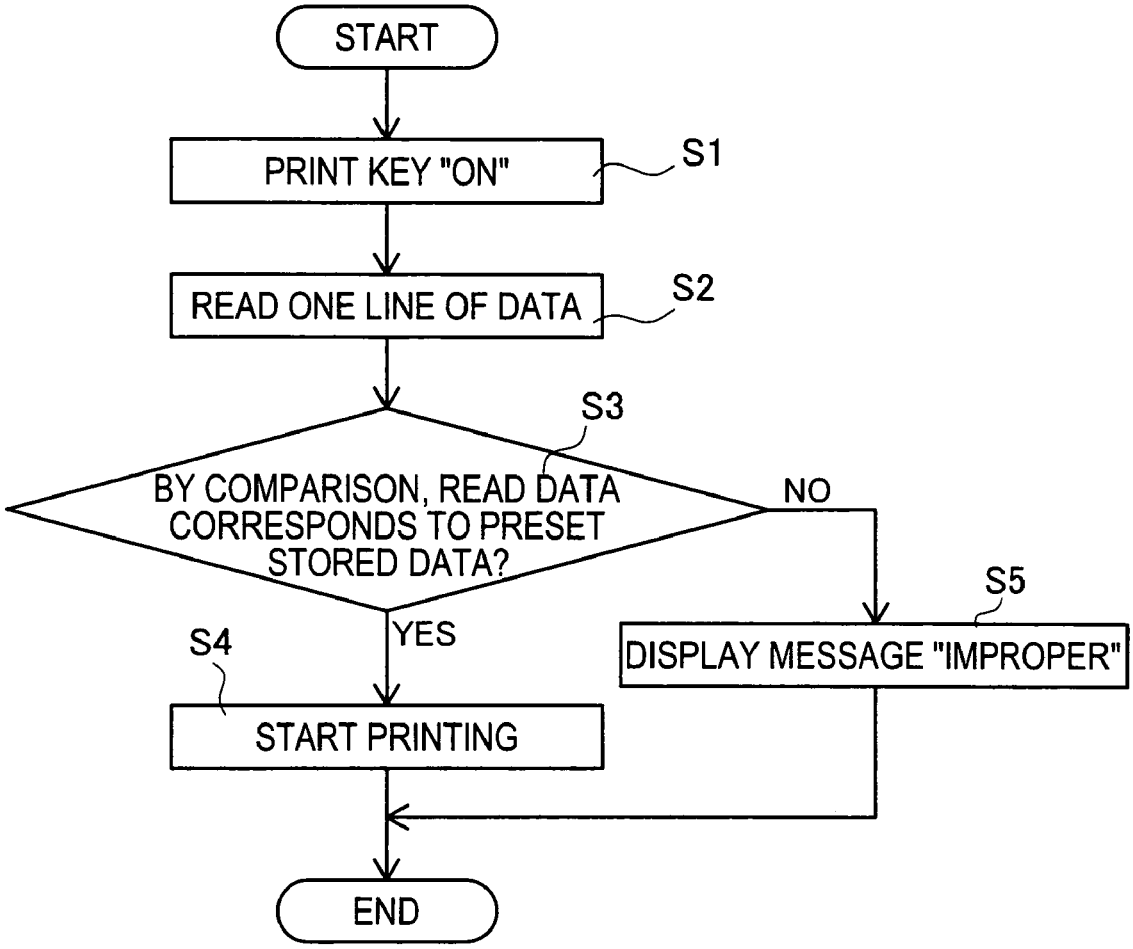
FIG. 12 is a flowchart showing a discrimination process of tape type discrimination sensors to determine a tape type of the tape cassette of the tape producing apparatus in the first embodiment by reading only one line of the marks with line CCDs without a feeding of a label tape.
Figure 13:
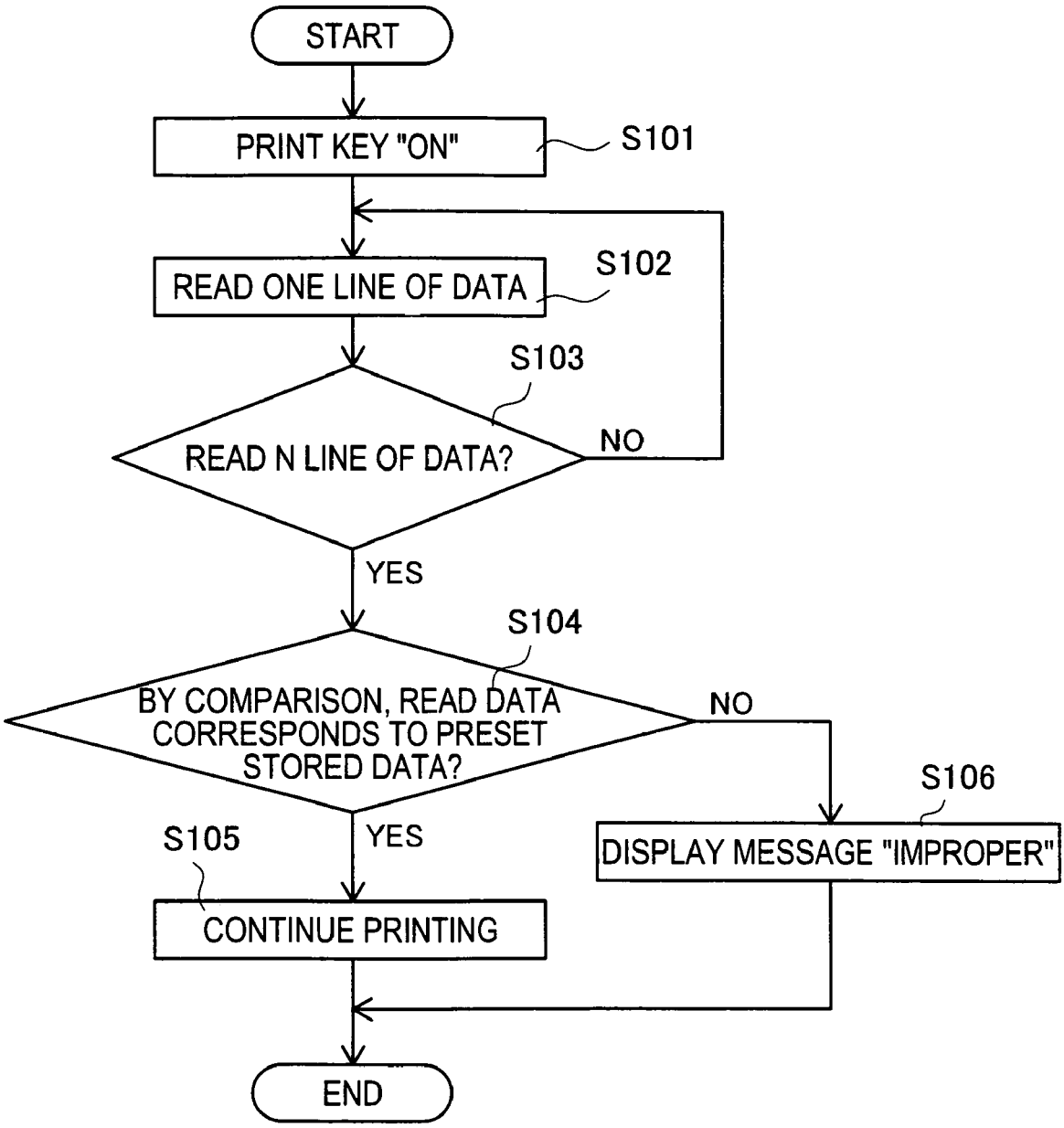
FIG. 13 is a flowchart showing a discrimination process of the tape type discrimination sensors to determine the tape type of the tape cassette of the tape producing apparatus in the first embodiment while the label tape is fed.

Next, the tape type discrimination sensors 4, 5 of the tape producing apparatus 1 of the above-mentioned configuration will be explained with reference to FIGS. 12 and 13. FIG. 12 is a flowchart showing a discrimination process of the tape type discrimination sensors to determine the tape type of the tape cassette of the tape producing apparatus in the first embodiment by reading only one line of the marks with the line CCDs without a feeding of the label tape. FIG. 13 is a flowchart showing a discrimination process of the tape type discrimination sensors to determine the tape type of the tape cassette of the tape producing apparatus in the first embodiment while the label tape is fed.

Firstly, the flowchart of FIG. 12 will be explained, based on a case of the tape cassette 21 being set, to show the discrimination process of the tape type discrimination sensor 4 to determine the tape type of the tape cassette 21 by reading only one line with the line CCD 38 without the feeding of the label tape. At step (hereinafter, "S") 1, the print key 3 is turned on to print the data input with the keyboard 6 onto the print tape 22. Then, the tape type discrimination sensor 4 of the line CCD 38 reads only one line of the mark data (S2), and the mark data is compared with those in the tape discrimination data table 60 stored in the tape discrimination data storage area 54A (S3). If the read mark corresponds to one of the preset tape type identification marks, the process goes on to S4, and printing will start to produce normal label tape 35. If not, the process goes to S5, and a message is displayed in the LCD 7 to inform that the tape cassette 21 is improper, and printing is stopped. This method to read only one line is suitable for the tape type identification marks 64 in FIG. 8 and the tape type identification marks 66 in FIG. 10.

When the tape cassette 45 is set, the tape type discrimination sensor 5, the line CCD 39, the print tape 46, and the label tape 49 work the same as the tape type discrimination sensor 4, the line CCD 38, the print tape 22, and the label tape 35 respectively in the above explanation of the flowchart in FIG. 12

Next, the flowchart of FIG. 13 will be explained, based on a case of the tape cassette 21 being set, to show a discrimination process for the tape type discrimination sensor 4 to determine the tape type of the tape cassette 45 while the label tape 35 is fed. At S101, the print key 3 is turned on to print the data input with the keyboard 6 onto the print tape 22. Then, the tape type discrimination sensor 4 of the line CCD 38 reads only one line of the mark data (S102), and the process goes on to S103, and it is determined if N lines' data has been read. If the read data is less than N lines, the process goes back to S102, and repeats until the read data reaches N lines. After the read data reaches N lines', the process goes to S104, and the data of N lines is compared with the marks in the tape discrimination data table 60 stored in the tape discrimination data storage area 54A. If the read data corresponds to one of the tape type identification marks, the process goes on to S104, and printing will start to produce normal label tape 35. If not, the process goes to S105, and a message informing that the tape cassette 21 is improper is displayed in the LCD 7, and printing is stopped.

When the tape cassette 45 is set, the tape type discrimination sensor 5, the line CCD 39, the print tape 46, and the label tape 49 work the same as the tape type discrimination sensor 4, the line CCD 38, the print tape 22, and the label tape 35 respectively in the above explanation of the flowchart in FIG. 13.

As explained in detail above, the tape producing apparatus 1 of the first embodiment comprises the non-contact tape type discrimination sensors 4, 5. The label tape 35 includes the adhesive and the release paper 16 for protecting the adhesive. The release paper 16 is provided with any one of the tape type identification marks 61 to 66 which are printed continuously to show the types of the materials to produce the label tape 35, 49. The non-contact tape type discrimination sensor 4 reads the tape type identification marks 61 to 66 which are printed continuously to show the type of the materials to produce the label tape 35. Therefore, using the non-contact tape type discrimination sensor 4, 5 develop reliability in contrast to a mechanical switch, and positioning tolerance can be larger. Since the cassette case 28 does not have sensor holes, both cassette cases 28 can be common, which can reduce costs. The non-contact tape type discrimination sensor 4 can get data from any part of the tape type identification marks 61 to 66. If anything other than the predetermined material to produce the label tape 35 is installed in the cassette case 28, the tape type discrimination sensor 4 reads the data of the tape type identification marks 61 to 66 directly, so that the process can be terminated promptly, and prevent trouble of the apparatus.

Furthermore, the tape producing apparatus 1 of the first embodiment has the release paper 16 on which any one of the tape type identification marks 61 to 66 are printed. That is, the tape type identification marks 61 to 66 printed on the release paper do not remain in the label tape 35 after the label tape 35 is stuck to the predetermined place. Accordingly, the data which is necessary before printing but unnecessary after printing can be removed from the produced label tape 35 by printing the data on the release paper 16.

The above mentioned effects can be also achieved in the case where the tape cassette 45 is set. The tape type discrimination sensor 5, the label tape 49, and the cassette case 48 function in the same manner as the tape type discrimination sensor 4, the label tape 35, and the cassette case 28.

Furthermore, the tape producing apparatus 1 of the first embodiment has the non-contact tape type discrimination sensors 4, 5 of the line CCDs 38, 39. The line CCDs 38, 39 can process images of the marks so successively as to be suitable for reading the marks indicating the types of the print tape 22 or 46 and ink for the label tape 35 which are continuously fed at high speeds. Even when the label tapes 35, 49 stops, the line CCDs 38, 39 can capture characteristic of the images respectively. Therefore, the line CCDs 38, 39 can function in either case where the label tapes are fed, or stop.

Figure 6:
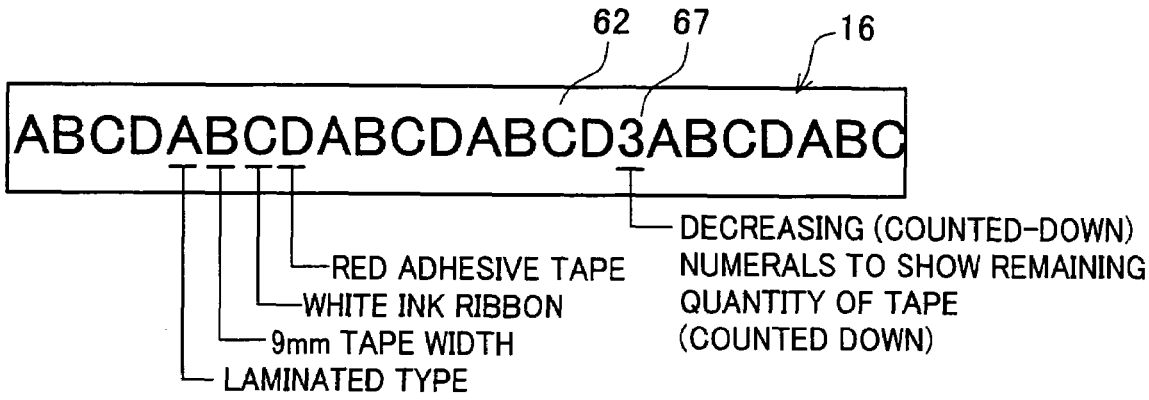
FIG. 6 is an explanatory drawing of the tape type identification marks of the disclosure in a second embodiment.

Next, a second embodiment of the tape producing apparatus 1 of the disclosure will be explained with reference to FIG. 6. In the second embodiment, another function is added to the tape type identification marks 62 which are continuously printed in the release paper 16 to show the type of the material to produce the label tape 35 composing the tape cassette 21 used for the tape producing apparatus 1. FIG. 6 is an explanatory drawing of the tape type identification marks of the disclosure in the second embodiment. Herein, parts which are functionally the same as those in the first embodiment are assigned the identical reference numbers to those in the first embodiment in order to omit another explanation.

As shown in FIG. 6, numerals (a single numeral "3" in this figure) indicated by a reference number 67 are added between the tape type identification marks 62 which are continuously printed on the release paper 16 to show the type of the material to produce the label tape 35. The numeral 67 indicate a remaining quantity of the print tape 22 on which letters and symbols are printed. Preferably, the numerals 67 are provided in decreasing order of numeric value toward the end of the tape. The more often the numerals 67 are inserted, the better. But the frequency should be kept within bounds of not interrupting the discrimination of the tape type identification marks 62. The tape type identification marks 62 and the numerals 67 to indicate the remaining quantity of the print tape 22 may be printed in two lines.

As explained above, in the tape producing apparatus 1 of the second embodiment, the release paper 16 has the numerals 67 to indicate the remaining quantity of the print tape 22 with the tape type identification marks 62 showing the type of the material to produce the label tape 35, so that the remaining quantity of the tape cassette 21 can be seen anytime to avoid trouble of the print tape 22 coming to the end during producing the label tapes 35.

Next, a third embodiment of the tape producing apparatus 1 of the disclosure will be explained with reference to FIG. 7. In the third embodiment, another function is added to the tape type identification marks 63 which are continuously printed on the release paper 16 to show the type of the material to produce the label tape 35 composing the tape cassette 21 used for the tape producing apparatus 1. FIG. 6 is an explanatory diagram of the tape type identification marks of the disclosure in the third embodiment. Herein, parts which are functionally the same as those in the first embodiment are assigned the identical reference numbers to those in the first embodiment in order to omit another explanation.

Figure 7:
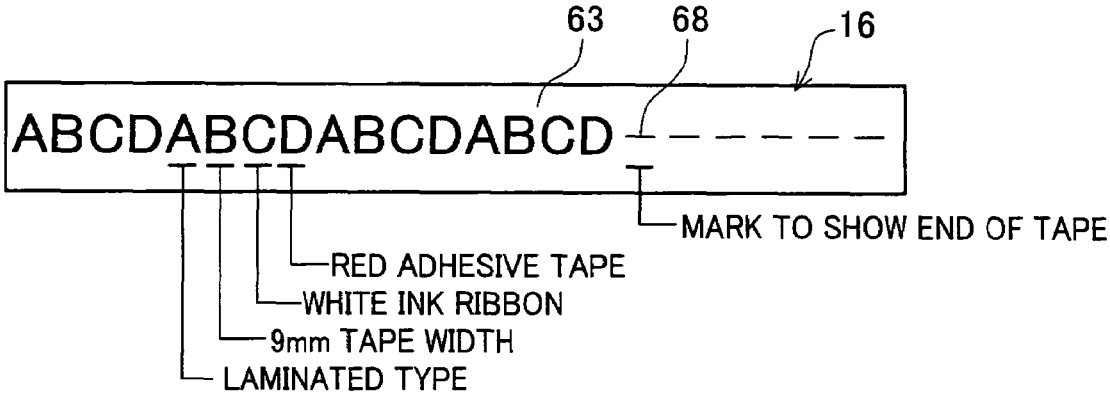
FIG. 7 is an explanatory drawing of the tape type identification marks of the disclosure in a third embodiment.

As shown in FIG. 7, a symbol 68 to indicate the end of the print tape 22 is inserted following a last one of the tape type identification marks 63 showing the type of material to produce the label tape 35. Conventionally, in the end of the print tape 22, there is attached an additional member.

As explained above, in the tape producing apparatus 1 of the third embodiment, the release paper 16 has the symbol 68 to indicate the end of the print tape 22 in addition to the tape type identification marks 62 to show the type of the material to produce the label tape 35, so that the end tape conventionally used is no longer needed, and the costs can be reduced.

Figure 8:
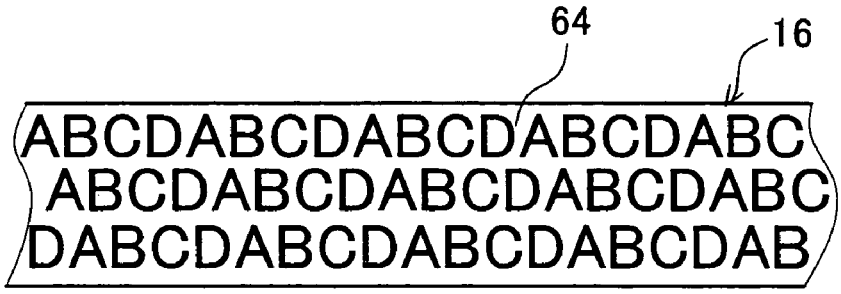
FIG. 8 is an explanatory drawing of the tape type identification marks of the disclosure in a fourth embodiment.

Next, a fourth embodiment of the tape producing apparatus 1 of the disclosure will be explained with reference to FIG. 8. In the fourth embodiment, another function is added to the tape type identification marks 64 which are continuously printed on the release paper 16 to show the type of the material to produce the label tape 35 composing the tape cassette 21 used for the tape producing apparatus 1. FIG. 8 is an explanatory diagram of the tape type identification marks of the disclosure in the fourth embodiment. Herein, parts which are functionally the same as those in the first embodiment are assigned the identical reference numbers to those in the first embodiment in order to omit another explanation.

As shown in FIG. 8, the tape type identification marks 64 to show the type of material to produce the label tape 35 are printed over multiple lines arranged out of alignment.

As explained above, in the tape producing apparatus 1 of the fourth embodiment, the release paper 16 has the tape type identification marks 64 to show the type of the material to produce the label tape 35 are printed over multiple lines arranged out of alignment, and the images necessary for identification are placed without interruption. Accordingly, the type of the material to produce the label tape 35 of the tape cassette 21 can be read without the need for feeding the label tape 35, so that producing the wasted label tape 35 can be avoided.

Figure 9:
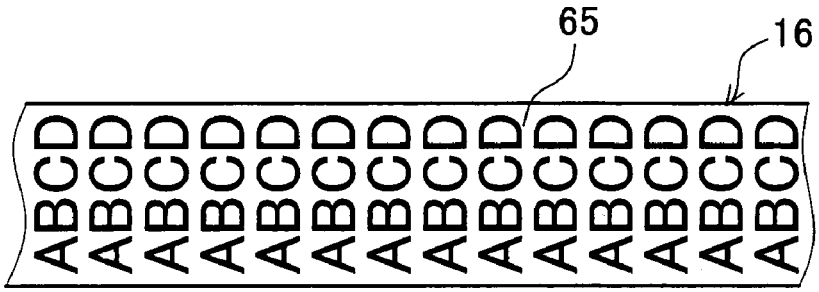
FIG. 9 is an explanatory drawing of the tape type identification marks of the disclosure in a fifth embodiment.

Next, a fifth embodiment of the tape producing apparatus 1 of the disclosure will be explained with reference to FIG. 9. In the fifth embodiment, another function is added to the tape type identification marks 65 which are continuously printed on the release paper 16 to show the type of the material to produce the label tape 35 composing the tape cassette 21 used for the tape producing apparatus 1. FIG. 9 is an explanatory diagram of the tape type identification marks of the disclosure in the fifth embodiment. Herein, parts which are functionally the same as those in the first embodiment are assigned the identical reference numerals to those in the first embodiment in order to omit another explanation.

As shown in FIG. 9, the tape type identification marks 65 to show the type of the material to produce the label tape 35 are printed in plural lines each of which is arranged perpendicularly with respect to a longitudinal direction of the release paper 16.

As explained above, in the tape producing apparatus 1 of the fifth embodiment, the tape type identification marks 65 to show the type of the material to produce the label tape 35 are continuously printed at the right angle to a feeding direction of the release paper 16. Accordingly, a feeding length of the label tape 35, needed for reading the material to produce the label tape 35 of the tape cassette 21 can be minimized.

Figure 10:
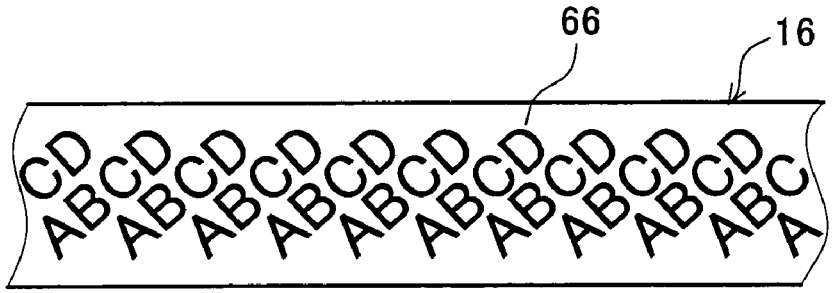
FIG. 10 is an explanatory drawing of the tape type identification marks of the disclosure in a sixth embodiment.

Next, a sixth embodiment of the tape producing apparatus 1 of the disclosure will be explained with reference to FIG. 10. In the sixth embodiment, another function is added to the tape type identification marks 66 which are continuously printed in the release paper 16 to show the type of the material to produce the label tape 35 composing the tape cassette 21 used for the tape producing apparatus 1. FIG. 10 is an explanatory diagram of the tape type identification marks of the disclosure in the sixth embodiment. Herein, parts which are functionally the same as those in the first embodiment are assigned the identical reference numerals to those in the first embodiment in order to omit another explanation.

As shown in FIG. 10, the tape type identification marks 66 to show the type of the material to produce the label tape 35 are printed in plural lines each of which is arranged at a slant with respect to the longitudinal direction of the release paper 16 with the same marks appearing repeatedly.

As explained above, in the tape producing apparatus 1 of the sixth embodiment, the tape type identification marks 66 to show the type of the material to produce the label tape 35 are printed diagonally to the longitudinal direction to the feeding direction of the release paper 16 without interruptions. Accordingly, the images necessary for the discrimination are placed continuously so that the type of the material to produce the label tape 35 of the tape cassette 21 are read unless the label tape 35 are fed, and producing the wasted label tape 35 can be avoided.

Figure 11A:
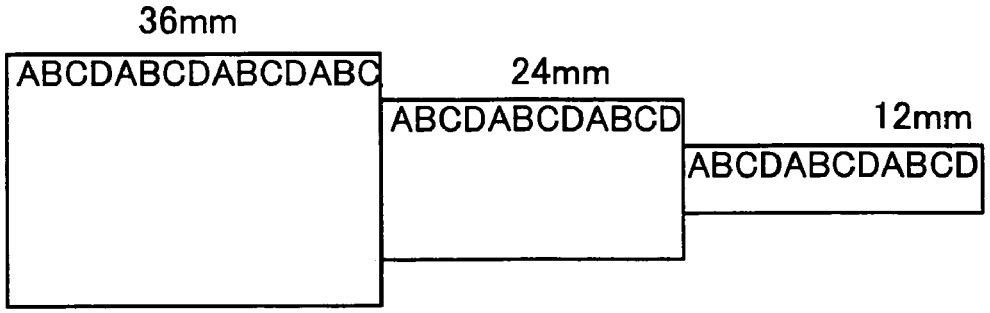
FIG. 11A is an explanatory drawing of the tape type identification marks of the disclosure in a seventh embodiment which changes a printing position depending on tape widths.
Figure 11B:
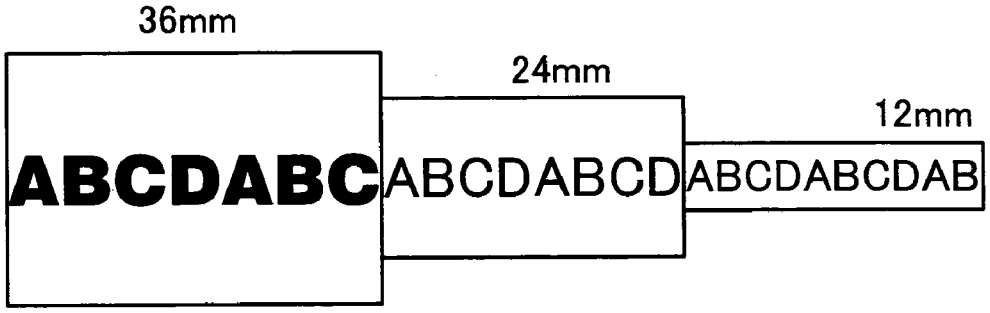
FIG. 11B is an explanatory diagram of the tape type identification marks of the disclosure in the seventh embodiment which changes a size and a thickness of characters depending on the tape widths.
Figure 11C:
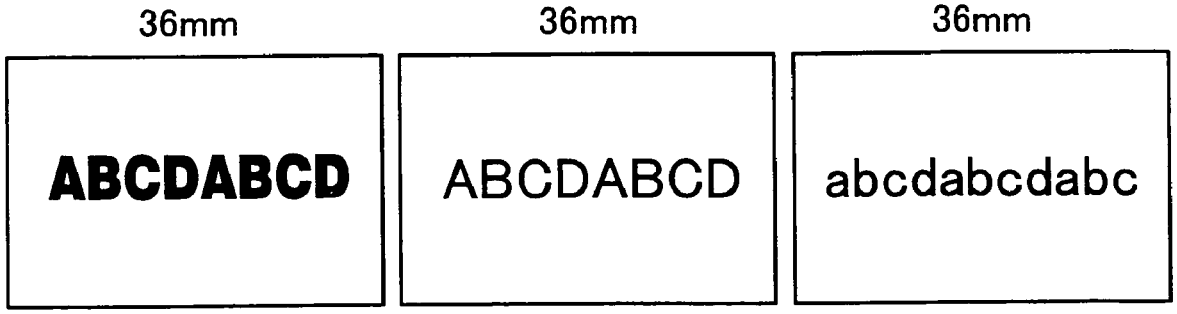
FIG. 11C is an explanatory diagram of the tape type identification marks of the disclosure in the seventh embodiment which changes the thickness of the characters and font types in a same tape width.

Next, a seventh embodiment of the tape producing apparatus 1 of the disclosure will be explained with reference to FIGS. 11A to 11C. In the seventh embodiment, another function is added to the tape type identification marks 66 which are continuously printed on the release paper 16 to show the type of the material to produce the label tape 35 composing the tape cassette 21 used for the tape producing apparatus 1. FIG. 11A is an explanatory drawing of the tape type identification marks of the disclosure in the seventh embodiment which changes the printing position depending on the tape widths. FIG. 11B is an explanatory diagram of the tape type identification marks of the disclosure in the seventh embodiment which changes the size and the thickness of the characters depending on the tape widths. FIG. 11C is an explanatory diagram of the tape type identification marks of the disclosure in the seventh embodiment which changes the thickness of the characters and font types in the same tape width. Herein, parts which are functionally the same as those in the first embodiment are assigned the identical reference numbers to those in the first embodiment in order to omit another explanation.

As shown in FIGS. 11A to 11C, the tape type identification marks 66 which are continuously printed to show the type of the material to produce the label tape 35 change its printing position, thickness and size of the characters depending on the widths of the tapes.

As explained above, in the tape producing apparatus 1 of the seventh embodiment, the tape type identification marks 66 are continuously printed on the release paper 16 at different positions or and sizes according to the material to produce the label tape 35, which is effective in cases where the tape type identification marks 66 are not enough to show the tape type.

When the tape cassette 45 is set, the label tape 49, the tape cassette 45, and the print tape 46 (see FIG. 3) perform the same functions of the label tape 35, the tape cassette 21, and the print tape 22 respectively, in second through seventh embodiments, they produce the same effect as above.

The disclosure may be embodied in other specific forms without departing from the essential characteristics thereof. For instance, a heat-sensitive coloring tape may be used in the disclosure. When the heat-sensitive coloring tape is used, the ink ribbon is unnecessary, and the cassette case does not house the ink ribbon, but houses the heat-sensitive coloring tape only.

While the presently preferred embodiment of the disclosure has been shown and described, it is to be understood that this disclosure is for the purpose of illustration and that various changes and modifications may be made without departing from the scope of the invention as set forth in the appended claims.

What is claimed is:

1. A tape producing apparatus comprising:

a tape printing medium;

a printing device for printing characters and symbols on the tape printing medium;

a label tape to be produced from the tape printing medium on which the printing device prints;

an adhesive applied on the label tape;

a release paper for protecting the adhesive;

tape type lettering identification marks for showing a type of a material to produce the label tape; and a non-contact tape type discrimination device for reading the tape type lettering identification marks.

2. The tape producing apparatus according to claim 1, wherein a mark showing a remaining quantity of the printing medium is printed as well as the tape type lettering identification marks on the release paper.

3. The tape producing apparatus according to claim 2, wherein the mark showing the remaining quantity of the printing medium includes numerals which are provided in decreasing order of numeric value.

4. The tape producing apparatus according to claim 1, wherein a mark showing an end of the printing medium is printed as well as the tape type lettering identification marks on the release paper.

5. The tape producing apparatus according to claim 1, wherein the tape type lettering identification marks are continuously printed on the release paper.

6. The tape producing apparatus according to claim 1, wherein the tape type lettering identification marks are continuously printed on the release paper in multiple lines which are arranged out of alignment.

7. The tape producing apparatus according to claim 1, wherein the tape type identification lettering marks are continuously printed on the release paper in plural lines each being arranged perpendicular with respect to a feeding direction of the release paper.

8. The tape producing apparatus according to claim 1, wherein the tape type lettering identification marks are continuously printed on the release paper in plural lines each being arranged at a slant with respect to the feeding direction of the release paper with the same marks appearing repeatedly.

9. The tape producing apparatus according to claim 1, wherein the tape type lettering identification marks showing the type of the material to produce the label tape are continuously printed on the release paper, in a predetermined printing position which is changed depending on kinds of the material.

10. The tape producing apparatus according to claim 1, wherein the tape type lettering identification marks showing the type of the material to produce the label tape are continuously printed on the release paper, in a predetermined printing size which is changed depending on the kinds of the material.

11. The tape producing apparatus according to claim 1, wherein the tape type discrimination device is a line CCD.

12. The tape producing apparatus according to claim 1, wherein the line CCD is provided at an exit for the label tape.

* * * * *